US005336116A

United States Patent [19]

Boteler

[11] Patent Number: 5,336,116

[45] Date of Patent: Aug. 9, 1994

[54] MALE ELECTRICAL PLUG ASSEMBLY WITH INCREASED ELECTRICAL CREEPAGE DISTANCE BETWEEN CONTACTS

[75] Inventor: William C. Boteler, Bridgeport, Conn.

[73] Assignee: Hubbell Incorporated, Orange, Conn.

[21] Appl. No.: 102,918

[22] Filed: Aug. 6, 1993

[51] Int. Cl.[5] ..... H01R 13/502

[52] U.S. Cl. ..... 439/690; 439/332

[58] Field of Search ..... 439/332, 335, 659, 686, 439/690–695, 701, 725, 727, 810–814

[56] References Cited

U.S. PATENT DOCUMENTS

| | | | |
|---|---|---|---|
| 1,630,166 | 5/1927 | Catlin et al. | 439/691 X |
| 4,003,618 | 1/1977 | Booty | 439/332 X |
| 4,199,207 | 4/1980 | Lee | 439/690 X |
| 4,255,007 | 3/1981 | Michaels et al. | 439/332 |
| 4,738,628 | 4/1988 | Rees | 439/332 X |

*Primary Examiner*—Khiem Nguyen

*Attorney, Agent, or Firm*—Jerry M. Presson; Michael R. Swartz

[57] ABSTRACT

A male electrical plug assembly includes an elongated body, a mounting flange, a terminal holder and a terminal retainer, all being made of an insulating material. The elongated body has a plurality of locating elements defined on an exterior surface on one end portion thereof and an annular shoulder defined thereon adjacent to the external locating elements. The mounting flange is adapted to fit over the elongated body and abut against the annular shoulder and has an internal annular wall with a plurality of recesses defined therein being alignable with the external locating elements of the elongated body. The terminal holder is adapted to fit over the elongated body in abutting relation against the mounting flange and has a plurality of cavities and a plurality of slots aligned with the cavities. The cavities and slots are alignable with the internal recesses of the mounting flange and the external locating elements of the elongated body. The terminal retainer is attachable to an opposite end of the elongated body so as to clamp the mounting flange and terminal holder therebetween. The assembly also includes a plurality of electrical terminals disposed in the cavities of the terminal holder and a plurality of elongated electrical contact elements mounted to the external locating elements on the one end portion of the elongated body and extendable therefrom through the internal recesses of the mounting flange and the cavities and slots of the terminal holder and into the electrical terminals disposed in the cavities.

20 Claims, 4 Drawing Sheets

MALE ELECTRICAL PLUG ASSEMBLY WITH INCREASED ELECTRICAL CREEPAGE DISTANCE BETWEEN CONTACTS

BACKGROUND OF THE INVENTION

1. Field of the Invention

The present invention generally relates to electrical couplers and, more particularly, is concerned with a male electrical plug assembly with increased electrical creepage distance between contacts.

2. Description of the Prior Art

Locking electrical couplers having male plugs and female connectors which first mate and then rotate relative to one another have been commercially available for many years for application in numerous industrial and special uses. These electrical couplers have generally incorporated 3 to 5 electrical contacts and have been rated at 20, 30, 50 and 60 Amps and from 125 VAC to 250 VDC and to 600 VAC.

Traditionally, the interior contact-carrying portion of the male plugs of these electrical couplers were manufactured by insert molding of forged or sintered electrical contacts, having swaged or wrought terminal shanks, into a thermoset insulating body. This traditional construction has both important advantages and disadvantages. The advantages are that the integrally molded assembly is resistant to both axial and rotational forces on the electrical contacts and that electrical creepage distances are limited only by the established configuration. Creepage distance refers to the shortest distance along the surface of insulating material between two conductive parts.

The disadvantages are that the thermoset molding cycle is extremely slow and the molds are susceptible to damage due to misplaced contact inserts. Also, insert molding requires the assistance of an operator. Further, post-molding machining is necessary to remove overmolded insulating material from the working surfaces of the contacts and to assure the tolerances required by the configuration for the diameters of these working surfaces. Furthermore, the thermosetting materials available have limited impact strength. The molding cycle time and the impact strength could be addressed by insert molding with a thermoplastic material, but the cost of the molds at risk from misplaced inserts would be much greater and the configuration would require section thicknesses which could not be molded in thermoplastic without excessive shrinking, sinking, voids and dimensional discrepancies.

Attempts have been made to replace the traditional insert molded/thermoset construction with an alternative constructional approach involving post molding assembly of electrical contacts and thermoplastic insulating parts. However, this alternative approach does not retain the inherent resistance of the traditional construction to axial forces on the contacts. Instead, the alternative approach relies on a small threaded fastener to resist separation due to tensile forces. Also, the minimum electrical creepage distance provided under the alternative approach is not commensurate with the 600 VAC rating of the electrical coupling device. The measured electrical creepage distance of one commercial device employing this alternative approach is only approximately 5.5 mm, whereas established international standards provide for electrical creepage distances ranging from 8 to 10 mm, depending upon the respective materials used.

Consequently, a need still exists for improvement in the construction of the male plugs for locking electrical couplers. The type of improvement desired is one which will retain the advantages of the traditional construction approach for male plugs while eliminating the disadvantages thereof but without introducing new disadvantages in the place of the old ones being eliminated.

SUMMARY OF THE INVENTION

The present invention provides a male electrical plug assembly designed to satisfy the aforementioned needs. The male electrical plug assembly of the present invention permits the achievement of increased electrical creepage distance between the electrical contacts of the plug. For example, the electrical creepage distances are at no point less than the established 10 mm requirement for the 30 Amp plug configuration. The male plug assembly of the present invention also provides features for interlocking of all parts so as to provide resistance to axial and rotational forces applied to the assembly.

Accordingly, the present invention is directed to a male electrical plug assembly which comprises: (a) a cylindrical body of insulating material having a plurality of locating elements on an exterior surface on one end of the body and a shoulder defined on the body adjacent to the one end thereof; (b) a mounting flange of insulating material adapted to fit over a portion of the cylindrical body and abut against the shoulder, the mounting flange having an internal annular wall with a plurality of recesses defined therein for alignment with the external locating elements; (c) a terminal holder of insulating material adapted to fit over a portion of the cylindrical body and abut against the mounting flange, the terminal holder having a plurality of cavities formed thereon and a plurality of slots therein aligned with the cavities, the cavities and slots being alignable with the internal recesses of the mounting flange and the external locating elements of the body; (d) a terminal retainer of insulating material attachable to an opposite end of the cylindrical body so as to clamp the mounting flange and terminal holder therebetween; (e) a plurality of electrical terminals disposed in the cavities of the terminal holder; and (f) a plurality of elongated electrical contact elements mounted to the external locating elements on the one end of the body and extendable therefrom through the internal recesses of the mounting flange and the cavities and slots of the terminal holder and into the electrical terminals disposed in the cavities of the terminal holder.

The male plug assembly also includes first means for interengaging the elongated body and mounting flange with the terminal holder so as to resist rotation of the terminal holder relative to the elongated body and mounting flange and to provide a predetermined electrical creepage distance between the electrical contacts at an interface formed between the mounting flange and terminal holder. The male plug assembly further includes second means for interengaging the terminal holder with the terminal retainer so as to resist rotation of the terminal retainer relative to the terminal holder.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
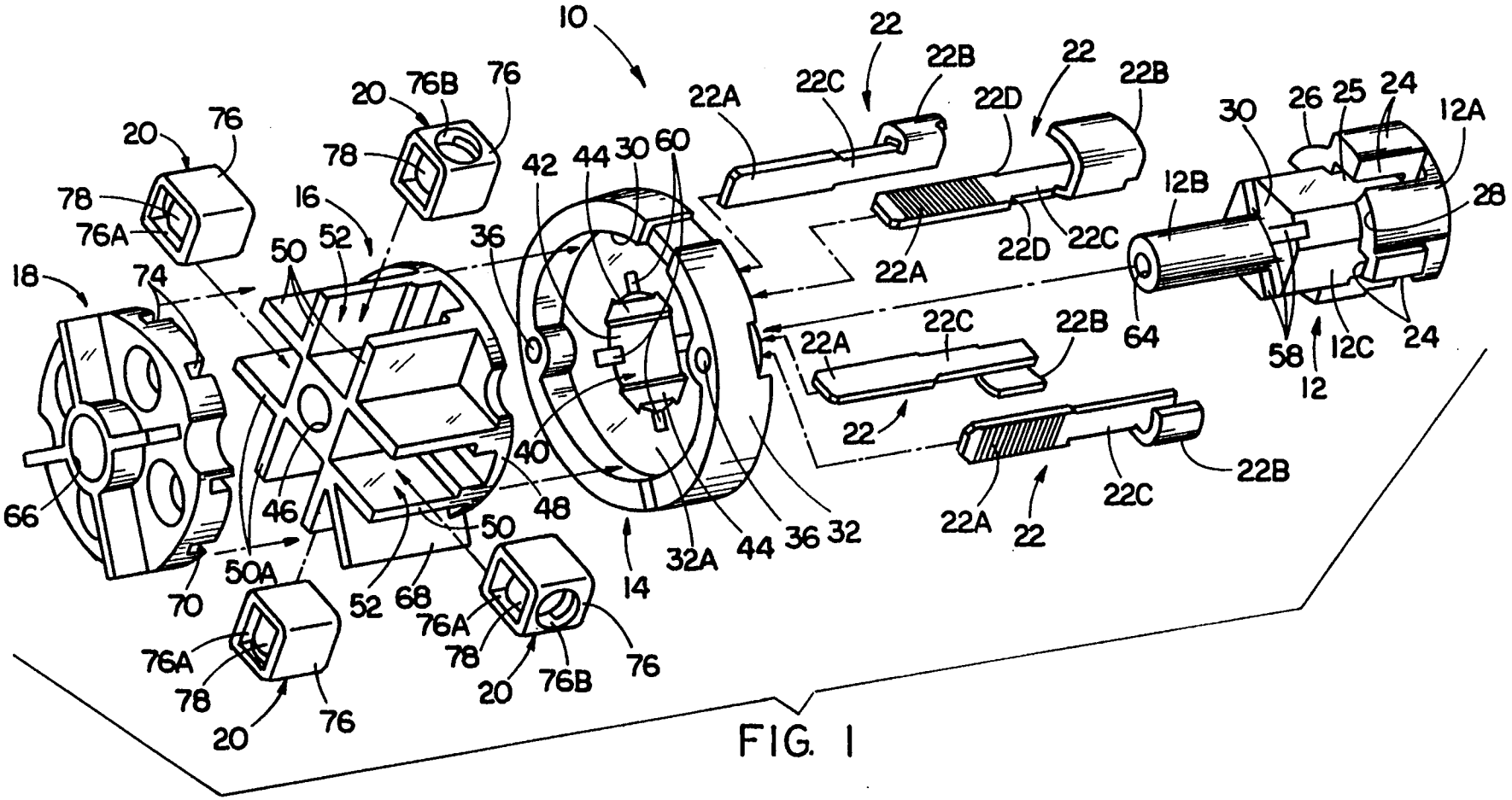
FIG. 1 is an exploded perspective view of a male electrical plug assembly in accordance with the present invention.

In the following description, like reference characters designate like or corresponding parts throughout the several views. Also in the following description, it is to be understood that such terms as "forward" "rearward" "left" "right" "upwardly" "downwardly" and the like, are words of convenience and are not to be construed as limiting terms.

Figure 2:
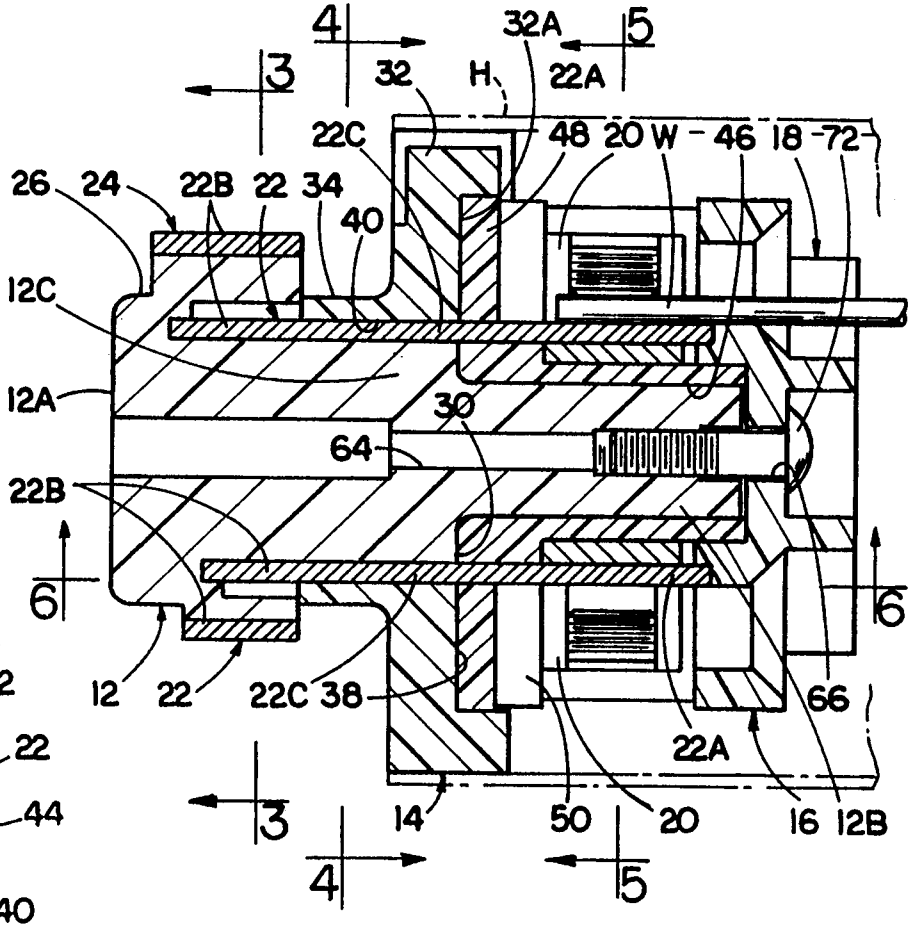
FIG. 2 is an enlarged longitudinal sectional view of the assembled male plug assembly.

Referring now to the drawings, and particularly to FIGS. 1 and 2, there is illustrated a male electrical plug assembly, generally designated 10, being constructed in accordance with the principles of the present invention. Basically, the male plug assembly 10 includes an elongated body 12, a mounting flange 14, a terminal holder 16 and a terminal retainer 18, all of which are made of a suitable insulating material. One suitable material is an impact resistant thermoplastic having a comparative tracking index of greater than 175 volts. The male plug assembly 10 also includes a plurality of electrical terminals 20 and a plurality of elongated electrical contact elements 22.

Figure 3:
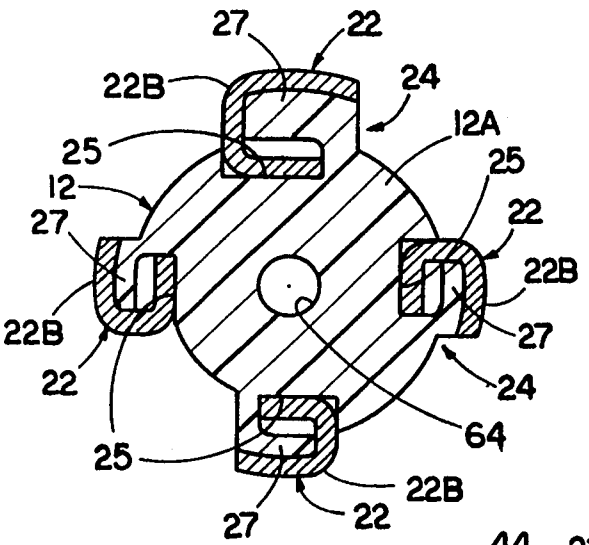
FIG. 3 is a cross-sectional view of the assembly taken along line 3—3 of FIG. 2.
Figure 4:
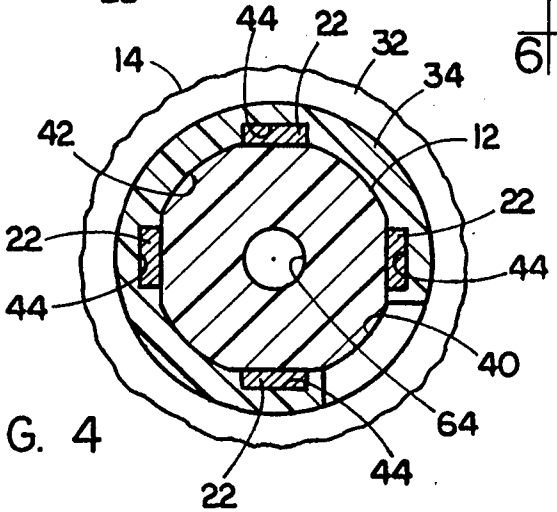
FIG. 4 is a cross-sectional view of the assembly taken along line 4—4 of FIG. 2.

More particularly, referring to FIGS. 1–4 and 7, the elongated body 12 of the assembly 10 has a plurality of external locating elements 24 defined on an exterior surface 26 on one end portion 12A thereof for mounting the respective contact elements 22, and a first annular shoulder 28 defined on the body 12 adjacent to the external locating elements 24. As best seen in FIGS. 1–3, each external locating element 24 includes a flat land or channel 25 defined in the one end portion 12A of the elongated body 12 and a tab 27 extending outwardly and circumferentially relative to the external surface 26 on the one end portion 12A and spaced outwardly from and overlying the channel 25. The elongated body 12 also has an opposite end portion 12B and a middle portion 12C axially aligned and integrally connected in series with the one end portion 12A and opposite end portion 12B. The middle portion 12C is larger in diameter than the opposite end portion 12B and smaller in diameter than the one end portion 12A so as to define the first annular shoulder 28 on the one end portion 12A facing axially in the direction of the middle portion 12C and a second annular shoulder 30 on the middle portion 12C facing axially in the direction of the opposite end portion 12B. The second annular shoulder 30 on the elongated body 12 is thus spaced from and smaller in diameter than the first annular shoulder 28 thereon.

Referring to FIGS. 1, 2, 7 and 8, the mounting flange 14 of the assembly 10 has an overall annular configuration and includes a large diameter disc-like base portion 32 and a small diameter tubular portion 34 attached thereon and extending axially from one side of the base portion 32. The mounting flange 14 has a pair of holes 36 through the outer peripheral edge of the base portion 32 for receiving fasteners (not shown) to attached the mounting flange 14 to a separate housing H, shown in phantom in FIGS. 2 and 7. The base portion 32 has a circular recess 38 defined therein facing in a direction opposite to that in which the tubular portion 34 projects from the base portion 32. The mounting flange 14 also has a central bore 40 adapting it to fit over the middle end portion 12C of the elongated body 12 and abut against the first annular shoulder 28 thereon. The mounting flange 14 also has an internal annular wall 42 defining the central bore 40. A plurality of recesses 44 are defined in the annular wall 42 and are aligned with the external locating elements 24 on the one end portion 12A of the elongated body 12.

Figure 5:
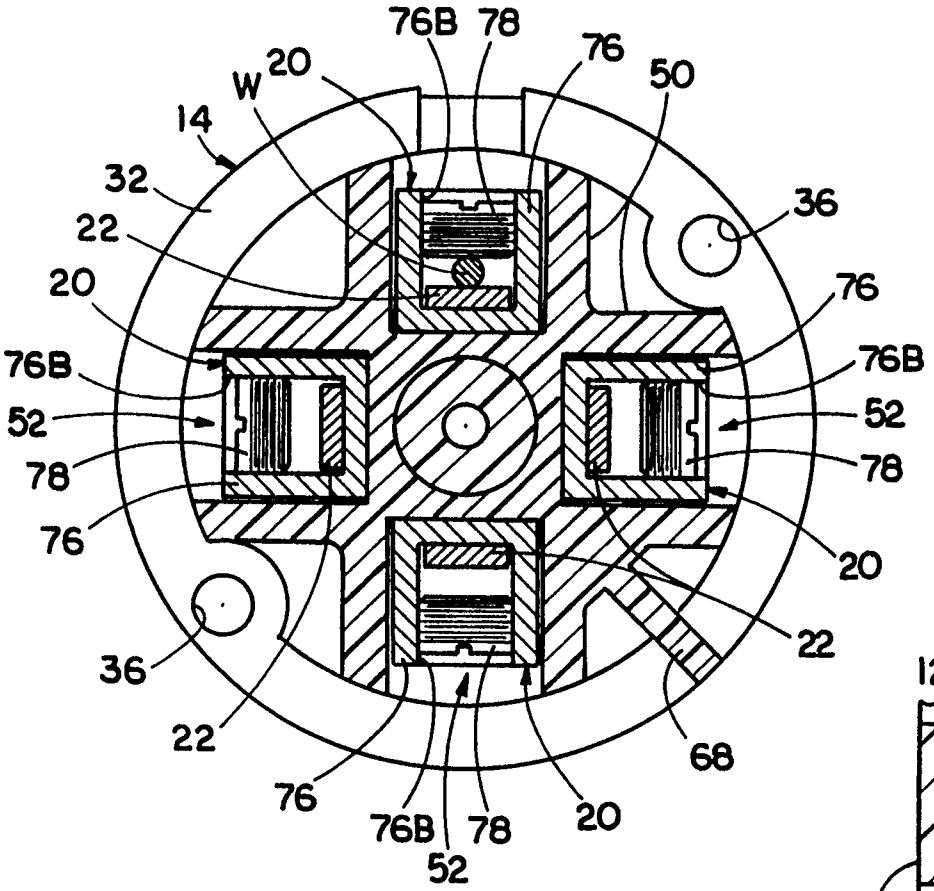
FIG. 5 is a cross-sectional view of the assembly taken along line 5—5 of FIG. 2.

Referring to FIGS. 1, 2 and 5, the terminal holder 16 of the assembly 10 has an overall annular configuration and a central bore 46 adapting it to fit over the opposite end portion 12B of the elongated body 12 in abutting relation against the mounting flange 14. More particularly, the terminal holder 16 includes a circular base 48 and an array of criss-cross walls 50 attached to and projecting from one side of the base 48 and defining a plurality of pockets or cavities 52 in a circumferentially spaced and isolated relationship from one another. Also, a plurality of slots 54 are defined in the base 48 in alignment with the respective cavities 52. The circular base 48 of the terminal holder 16 is adapted to fit and seat within the circular recess 38 of mounting flange 14. Also, the cavities 52 and slots 54 of the terminal holder 16 are aligned with the internal recesses 44 of the mounting flange 14 and the external locating elements 24 of the elongated body 12.

Figure 7:
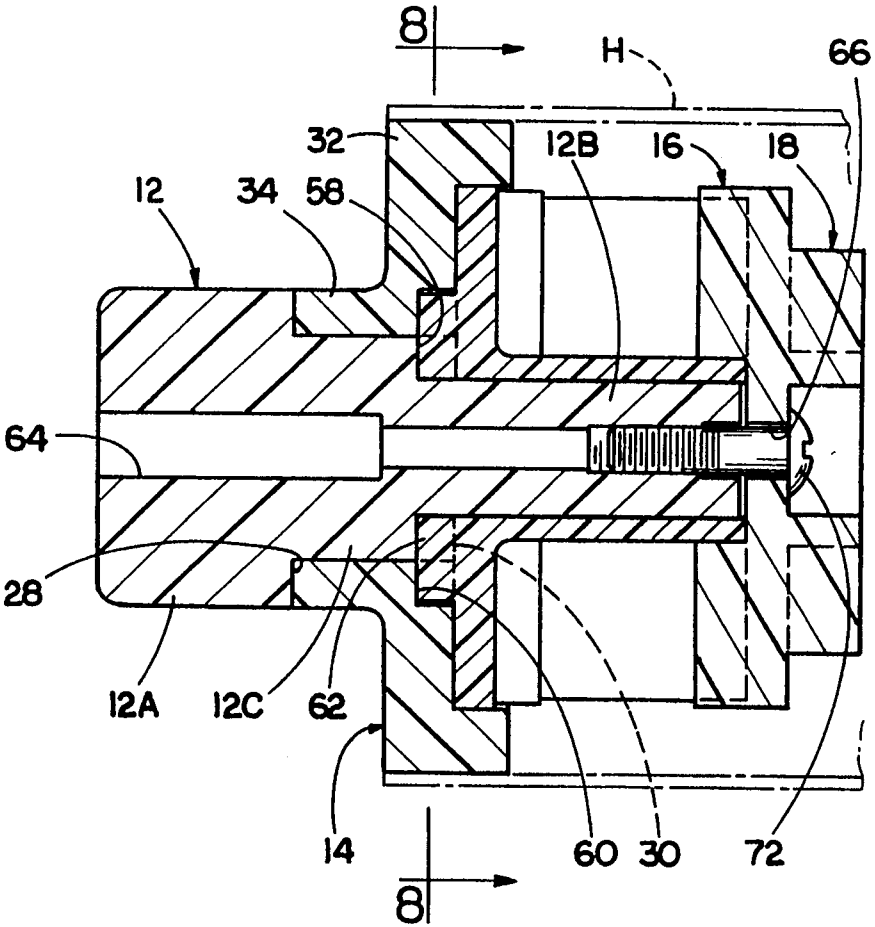
FIG. 7 is a longitudinal sectional view of the assembly taken along line 7—7 of FIG. 8 and along a plane angularly displaced approximately 45° from that of the view of FIG. 2.
Figure 8:
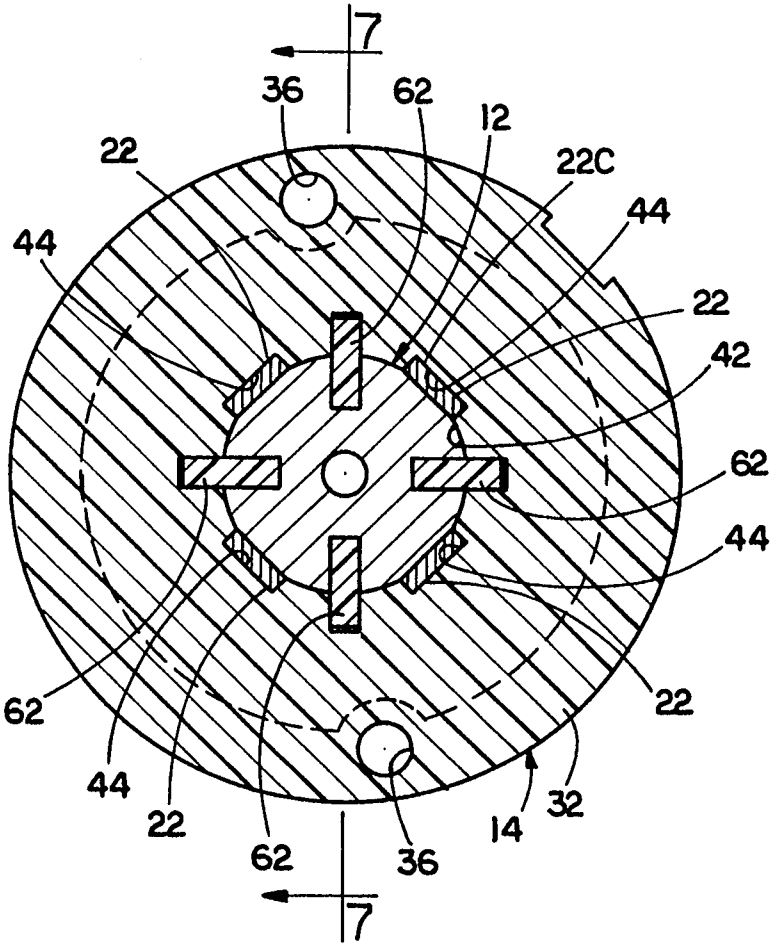
FIG. 8 is a cross-sectional view of the assembly taken along line 8—8 of FIG. 7.

Referring to FIGS. 1, 7 and 8, the assembly 10 also includes first means for interengaging the elongated body 12 and mounting flange 14 with the terminal holder 16 so as to resist and prevent rotation of the terminal holder 16 relative to the elongated body 12 and mounting flange 14 and also to provide a predetermined electrical creepage distance between the electrical contact elements 22 at an interface 56 formed between the terminal holder 16 and mounting flange 14. The first interengaging means includes the second annular shoulder 30 on the elongated body 12 and an inner plurality of radial slots 58 defined in the second annular shoulder 30. The first interengaging means also includes an outer plurality of radial slots 60 defined in the mounting flange and being radially aligned with the inner plurality of radial slots 58 on the body 12. The first interengaging means further includes a plurality of radial ribs 62 formed on the terminal holder 16 and aligned with and inserted within the inner and outer pluralities of aligned radial slots 58, 60 in the body 12 and mounting flange 14. The outer radial slots 60 of the mounting flange 14 open into the circular recess 38 thereof. The radial ribs 62 of the terminal holder 16 are formed on its circular base 48 and project therefrom. Thus, as best seen in FIG. 7, when the circular base 48 is seated within the circular recess 38 of the mounting flange 14, the radial ribs 62 on the terminal holder 16 extend into the radially-aligned inner and outer radial slots 58, 60 of the body 12 and mounting flange 14.

Referring to FIGS. 1, 2 and 7, the terminal retainer 18 of the assembly 10 is attachable to the opposite end portion 12B of the elongated body 12 so as to clamp the mounting flange 14 and terminal holder 16 therebetween. The opposite end portion 12B of the elongated body 12 has an internally-threaded central opening 64 whereas the terminal retainer 18 has a central aperture 66 being aligned with the central opening 64 when a indexing key 68 on the terminal holder 16 is aligned and inserted into a keyway 70 in the terminal retainer 18. An externally-threaded fastener 72 is inserted through the central aperture 66 of the terminal retainer 18 and threadably inserted and screwed into the internally-threaded central opening 64 of the elongated body 12 so as to attach the terminal retainer 18 to the elongated body 12 and tightly clamp the mounting flange 14 and terminal holder 16 therebetween. The terminal retainer 18 also functions to close the open ends of the cavities 52 which contain the electrical terminals 20.

Referring to FIGS. 1 and 2, the assembly 10 further includes second means for interengaging the terminal holder 16 with the terminal retainer 18 so as to resist rotation of the terminal retainer 18 relative to the terminal holder 16. The second interengaging means includes the outer end edges 50A of the array of crisscross walls 50 of the terminal holder 16 and an array of criss-cross channels 74 formed in the side of the terminal retainer 18 facing toward the terminal holder 16. The channels 74 receive therein the outer end edges 50A of the criss-cross walls 50 and in such manner resist rotation of the terminal retainer 18 relative to the terminal holder 16.

Referring to FIGS. 1, 2, 5 and 6, the electrical terminals 20 are configurated to be disposed in the cavities 52 of the terminal holder 16. Each electrical terminal 20 includes a hollow box-like rectangular structure 76 being open at opposite ends 76A to permit insertion of a portion of one of the elongated contact elements 22 therethrough. Also, each terminal structure 76 has an aperture 76B tapped in an outer side and an fastener element 78 is provided being threadably adjustably attached to the hollow rectangular structure 76 within the aperture 76B thereof. The fastener element 78 can be screwed toward and away from the portion of the contact element 22 extending through the terminal structure 76 so as to clamp an end of an electrical conductor wire W between the contact element 22 and the fastener element 78, as seen in FIG. 2.

Figure 6:
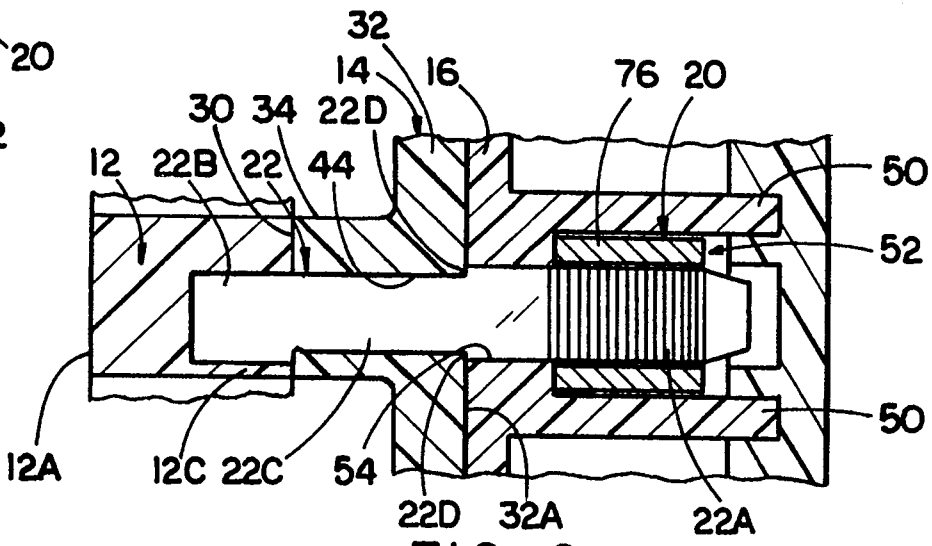
FIG. 6 is fragmentary longitudinal sectional view of the assembly taken along line 6—6 of FIG. 2.

The elongated electrical contact elements 22 are mounted to the external locating elements 24 on the one end portion 12A of the elongated body 12 and extend therefrom through the internal recesses 44 of the mounting flange 14 and the cavities 52 and slots 54 of the terminal holder 16 and into the electrical terminals 20 disposed in the cavities 52. Each of the elongated contact elements 22 has a shank portion 22A, head portion 22B and neck portion 22C. The neck portion 22C extends between and rigidly and integrally interconnects the shank and head portions 22A, 22B. The neck portion 22C has a transverse width which is smaller than that of both the shank and head portions 22A, 22B. The head portions 22B of the contact elements 22 are interengaged with the respective locating elements 24 on the one end portion 12A of the elongated body 12. The channel 25 of each locating element 24 is adapted to receive and seat the head portion 22B of one contact element 22. The tab 27 of each locating element 24 overlying one of the channels 25 mounts thereon the head portion 22B of the one contact element 22. The shank portions 22A of the contact elements 22 extend through the cavities 52 and slots 54 of the terminal holder 16 and into the electrical terminals 20. The neck portions 22C of the contact elements 22 extend through the recesses 44 of the mounting flange 14. Due to their reduced widths, the neck portions 22C of the contact elements 22 are captured between the second annular shoulder 30 of the elongated body 12 and the circular base 48 of the terminal holder 16 when the opposite end portion 12B of the body 12 is inserted through the central bore 40 of the mounting flange 14. Because of the reduced width of the neck portion 22C relative to the shank portion 22A which forms spaced shoulders 22D on the inner ends of the shank portions 22A that abut against the inner face 32A of the mounting flange 14 as best seen in FIG. 6, the contact elements 22 cannot be pulled in either direction from the mounting flange 14 without first removing the elongated body 12. Thus, due to such abutting arrangement of the contact elements 22 with the mounting flange 14, the components of the male plug assembly 10 are prevented from being pulled apart by inadvertent pulling on the cord of the plug assembly 10 when it is locked in position within a female receptacle without first rotating the male plug assembly 10 relative to the female receptacle for unlocking of one from the other.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A male electrical plug assembly, comprising:

(a) an elongated body of insulating material having a plurality of locating elements defined on an exterior surface of one end portion of said body and a first annular shoulder defined on said body adjacent to said one end portion thereof;

(b) a mounting flange of insulating material adapted to fit over said elongated body and abut against said first annular shoulder, said mounting flange having an internal annular wall with a plurality of recesses defined therein being alignable with said external locating elements on said body;

(c) a terminal holder of insulating material adapted to fit over said elongated body and abut against said mounting flange, said terminal holder having a plurality of cavities formed thereon and a plurality of slots therein aligned with said cavities, said cavities and slots being alignable with said internal recesses of said mounting flange and said external locating elements of said body;

(d) a terminal retainer of insulating material attachable to an opposite end portion of said elongated body so as to clamp said mounting flange and terminal holder therebetween;

(e) a plurality of electrical terminals disposed in said cavities of said terminal holder A4; and (f) a plurality of elongated electrical contact elements mounted to said external locating elements on said one end portion of said body and extendable therefrom through said internal recesses of said mounting flange and said cavities and slots of said terminal holder and into said electrical terminals disposed in said cavities of said terminal holder.

2. The assembly as recited in claim 1, wherein:

said opposite end portion of said elongated body has an internally-threaded central opening defined therein; and said terminal retainer has a central aperture defined therein being alignable with said internally-threaded central opening of said elongated body.

3. The assembly as recited in claim 2, further comprising:

an externally-threaded fastener adapted to be inserted through said central aperture of said terminal retainer and threadably inserted into said internally-threaded central opening of said elongated body to attach said terminal retainer to said elongated body.

4. The assembly as recited in claim 1, further comprising:

first means for interengaging said elongated body and mounting flange with said terminal holder so as to resist rotation of said terminal holder relative to said elongated body and mounting flange and to provide a predetermined electrical creepage distance between said electrical contacts at an interface formed between said terminal holder and mounting flange.

5. The assembly as recited in claim 4, wherein said first interengaging means includes:

a second annular shoulder on said elongated body being spaced from and smaller in diameter than said first annular shoulder on said elongated body; and an inner plurality of radial slots defined in said second annular shoulder.

6. The assembly as recited in claim 5, wherein said first interengaging means also includes an outer plurality of radial slots defined in said mounting flange and being alignable with said inner plurality of radial slots defined in said elongated body.

7. The assembly as recited in claim 6, wherein said first interengaging means further includes a plurality of radial ribs formed on said terminal holder and being alignable with and insertable within said inner and outer pluralities of aligned radial slots in said elongated body and mounting flange.

8. The assembly as recited in claim 7, wherein:

said mounting flange has a circular recess defined in an end thereof, said outer radial slots of said mounting flange being formed in said mounting flange so as to open into said circular recess thereof; and said terminal holder has a circular base defined on one end thereof, said radial ribs of said terminal holder being formed on said circular base and projecting therefrom, said circular base being adapted to fit within said rearward circular recess of said mounting flange with said radial ribs of said terminal holder extending into said inner and outer radial slots of said elongated body and mounting flange.

9. The assembly as recited in claim 1, further comprising:

second means for interengaging said terminal holder with said terminal retainer so as to resist rotation of said terminal retainer relative to said terminal holder.

10. The assembly as recited in claim 1, wherein said terminal holder includes:

a base defined at one end thereof, said base having said plurality of slots defined therethrough; and an array of criss-cross walls attached to and projecting from said base and defining said plurality of cavities in a spaced and isolated relationship from one another and being aligned with said slots.

11. The assembly as recited in claim 10, further comprising:

second means for interengaging said terminal holder with said terminal retainer so as to resist rotation of said terminal retainer relative to said terminal holder.

12. The assembly as recited in claim 11, wherein said second interengaging means includes:

outer edges of said array of criss-cross walls of said terminal holder; and an array of criss-cross channels formed in said terminal retainer and receiving therein said outer edges of said array of criss-cross walls on said terminal holder, said outer edges of said array of criss-cross walls of said terminal holder being alignable with and insertable in said array of criss-cross channels of said terminal retainer.

13. The assembly as recited in claim 1, wherein each of said electrical terminals includes:

a hollow rectangular structure being open at opposite ends to permit insertion of a portion of one of said elongated contact elements therethrough; and a fastener element adjustably attached to said hollow rectangular structure so as to undergo movement toward and away from said portion of said one contact element to clamp an end of an electrical conductor wire between said one contact element and said fastener element.

14. The assembly as recited in claim 1, wherein each of said elongated contact elements has a shank portion, head portion and neck portion, said neck portion extending between and interconnecting said shank and head portions and having a transverse width smaller than that of said shank and head portions.

15. The assembly as recited in claim 14, wherein said head portions of said contact elements are interengaged with said locating elements on said one end portion of said elongated body.

16. The assembly as recited in claim 15, wherein each of said locating elements includes:

a channel defined in said one end portion of said elongated body adapted to receive and seat said head portion of one of said contact elements; and a tab extending outwardly and circumferentially relative to said external surface of said one end portion and spaced outwardly from and overlying said channel so as to mount thereon said head portion of said one contact element.

17. The assembly as recited in claim 14, wherein said shank portions of said contact elements extend through said cavities and slots of said terminal holder and into said electrical terminals.

18. The assembly as recited in claim 14, wherein said neck portions of said contact elements extend through said recesses of said mounting flange such that said elongated body and said mounting flange capture said electrical contact elements so as to prevent removal of said contact elements from said recesses in either axial direction along said contact elements.

19. The assembly as recited in claim 1, wherein said elongated body has a middle portion being axially aligned and integrally connected in series with one end portion and opposite end portion, said middle portion being larger in diameter than said opposite end portion and smaller in diameter than said one end portion so as to define said first annular shoulder on said one end portion facing axially in the direction of said middle portion and said second annular shoulder on said middle portion facing axially in the direction of said opposite end portion.

20. The assembly as recited in claim 19, wherein:

said mounting flange is fitted over said middle end portion of said elongated body; and said terminal holder is fitted over said opposite end portion of said elongated body.

* * * * *